United States Patent [19]

Lankry

[11] Patent Number: 4,867,019

[45] Date of Patent: Sep. 19, 1989

[54] SCREWDRIVING TOOL

[76] Inventor: Julien J. L. Lankry, Hillcrest, Brookdale Rd., Gatley, Cheadle, Cheshire, United Kingdom

[21] Appl. No.: 51,908

[22] Filed: May 19, 1987

[51] Int. Cl.[4] ..... B25B 23/155

[52] U.S. Cl. ..... 81/474

[58] Field of Search ..... 173/93, 93.5, 12; 81/474, 52

[56] References Cited

U.S. PATENT DOCUMENTS 4,262,501 4/1981 Vaughn et al. ..... 81/474 X 4,653,358 3/1987 Lankry ..... 81/474

*Primary Examiner*—Frank T. Yost

*Assistant Examiner*—Willmon Fridie, Jr.

*Attorney, Agent, or Firm*—Pearson & Pearson

[57] ABSTRACT

A screw driving tool comprises a housing in which are located two plates having recesses therein in which balls are received. One plate is adjustable located in the housing whilst the other plate is slidable therein and biased by a spring towards the located plate. The balls provide a driving connection between the plates to transmit the drive from a power tool, in which a shaft connected to the slidable plate is received, to a screw driving bit received in a bore of the other plate. When the screwing torque reaches a predetermined amount the force of the spring is overcome and relative rotation of the plates can occur and the driving bit can cease to rotate with the shaft.

16 Claims, 1 Drawing Sheet

SCREWDRIVING TOOL

This invention relates to tools, and in particular to tools for use in tightening or removing screw threaded fasteners such as screws, bolts or the like.

It is known to use power tools for the above purpose and specially adapted power tools are known for such use. The use of such power tools is particularly advantageous when a large number of screws or the like are to be tightened or removed since in such cases the use of hand tools can be time consuming, wearying and cause discomfort to the operator. However, specially adapted power tools are costly. In order to overcome this latter problem it is known to provide attachments for power drills which when coupled to a power drill enable the drill to be used in the same manner as a specially adapted power tool. Attachments of this type are described in, for example, British Pat. Nos. 1574911 and 2088264.

However in use of such attachments an operator can experience some difficulty either at the end of screw insertion if the screw head is not released by the screwdriver bit quickly and smoothly, or during screwing if the resistance to screwing is excessive. In such cases the drill can be difficult to control or can even be wrested from the operator's hand. It is an object of the present invention to provide a screwdriving tool which avoids or substantially alleviates this problem.

The invention provides a screwdriving tool having a shaft member at one end thereof adapted to be received in the jaws of a rotary machine, a screwdriving member disposed at the other end of said tool and a driving connection between said shaft member and said screwdriving member, said driving connection comprising a pair of plates having opposed respective faces resiliently biassed towards each other, each of said faces having at least one recess therein, said recesses being positioned for mutual alignment, and a rolling member adapted to be received partly in each of said aligned recesses.

Preferably each of said faces has a like plurality of recesses disposed equi-spaced radially from a central longitudinal axis of said tool and angularly around said axis. Each face may have three recesses therein. Preferably a like plurality of rolling members is provided, and said rolling members are preferably balls.

Said plates may be disposed in a housing, one of said plates being positionally located in said housing the other of said plates being slidably received therein, and spring means may be provided between an end wall of said housing and said other of said plates. Said one of said plates may be positionally adjustable axially of said housing, and said housing may be provided with a plurality of grooves of differing length extending longitudinally thereof in any chosen one of which a spigot on said one plate may be received.

One embodiment of screwdriving tool will now be described with reference to the accompanying drawing in which.

Referring now to the figures there is shown a screwdriving tool 10 comprising a shaft member 11 at one end thereof and a screwdriving member 12 at the other end thereof. The shaft member 11 may be of circular or hexagonal cross-section, or other cross-section if preferred, so as to be receivable in the jaws of a rotary machine (not shown) such as a conventional powered hand-drill.

Figure 1:
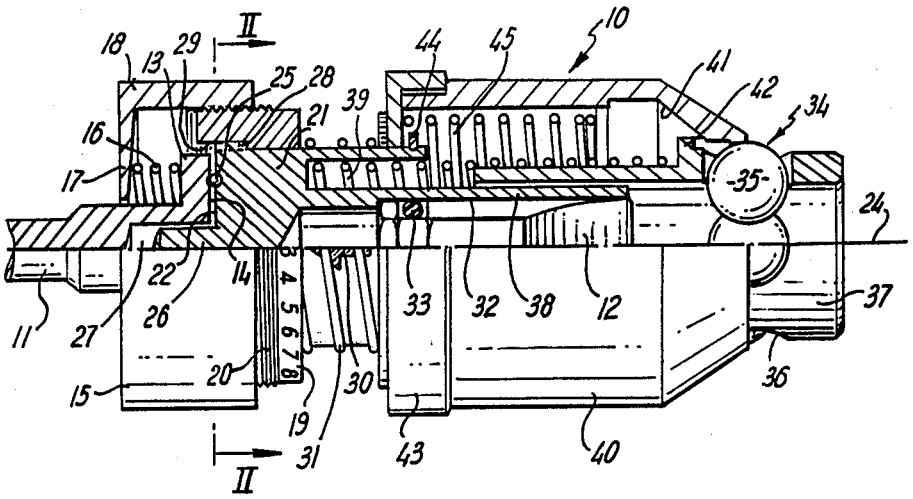
FIG. 1 is an elevation partly in longitudinal section.
Figure 2:
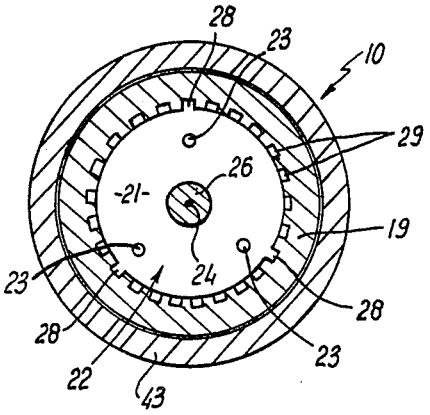
FIG. 2 is a view on line II—II of FIG. 1 with the housing cover removed.

One end of the shaft member 11 is provided with an annular flange or plate 13 having an end face 14. The shaft member 11 is slidably received in a housing 15 with the plate 13 within the housing 15 and resiliently biassed towards the other end of the tool 10 by a compression spring 16 located between the plate 13 and the end wall 17 of a housing cover 18. The housing 15 comprises the housing cover 18 and an annular part 19 which have cooperating screw threads 20 to enable them to be separated if required and also to enable the axial length of the housing 15 to be adjusted. Also received in the housing 15 is a second plate member 21 having an end face 22 in opposed disposition to the end face 14 of plate 13. Each end face 14,22 has three substantially hemispherical recesses 23 therein arranged equally spaced radially from the longitudinal axis 24 of the tool 10 and equi-angularly spaced around that axis 24. Received partly in each of two aligned recesses 23 is a ball 25. Plate 13 and plate member 21 are located relative to each other by means of a spigot 26 on the latter being received in an axial blind bore 27 in the former, although the bore 27 could of course be in the latter and the spigot 26 on the former if preferred. Plate member 21 is located relative to the annular housing part 19 by means of each one of three spigots 28 being received in a chosen respective one of a plurality of grooves 29 provided in the housing part 19, the grooves 29 being of differing length extending longitudinally of the tool 10. In the embodiment shown there are three spigots 28 and three sets of eight grooves 29, the latter being numbered 1 to 8 on the outer surface of the housing part 19 as shown in the lower half of FIG. 1, and selectable by appropriate positioning of the arrow 30 marked on the outside of plate member 21. A compression spring 31 ensures that the spigots 28 remain in the grooves 29 when the housing cover 18 is removed. Obviously a different number of spigots 28, sets of grooves 29 and number of grooves in each set may be provided if desired, and/or a different number of balls 25 and recesses 23 may be provided if desired.

By choosing which groove 29 a spigot 28 is received in, housing part 19 being slid longitudinally and then rotated about axis 24 relative to plate member 21 for this purpose, and by screwing housing cover 18 relative to housing part 19, the axial length of spring 16 can be adjusted, and hence the compressive force biassing faces 14,22 towards each other can be adjusted.

The screw driving member 12 is of hexagonal cross-section and is received in a hexagonal cross-sectioned axially extending recess 32 in the end of plate member 21 remote from the end face 22 and removably retained therein by means of a resilient O-ring 33. If the shaft member 11 is received in the chuck of a powered hand drill and the screwdriving member 12 engages a screw, the screw can be rotated in the appropriate direction, the force provided by spring 16 creating a driving connection between the shaft member 11 and the screwdriving member 12 through the balls 25 being received in recesses 23 in the biassed together end faces 14,22. If however the resistance to turning of the screw exceeds a certain amount the force of spring 16 will be overcome, the plate member 13 will move away from the plate member 21 and will rotate relative thereto, thereby severing the driving connection between the shaft member 11 and the screwdriving member 12. The amount of torque resistance to turning of the screw at which the drive connection between the shaft member 11 and the screwdriving member 12 is severed is determined by the force of spring 16 which can be adjusted as previously described.

To assist the operator in controlling the retention of the tool 10 in contact with the head of the screw and in respect of the direction of insertion of a screw into a workpiece or fixture, screw retention means 34 is provided. The screw retention means 34 comprises a plurality of balls 35 each received in a respective aperture 36 provided in a sleeve 37. The sleeve 37 is slidably received on the cylindrical part 38 of the plate member 21 within which the screwdriving part 12 is received, and is resiliently biassed away from the housing 15 by spring 39. Retaining the sleeve 37 and the balls 35 in the recesses 36 in sleeve 37 is an outer sleeve 40 having a stepped and tapered internal bore 41. A radial flange 42 on the sleeve 37 provides a reaction abutment for the spring 39 and a stop for the sleeve 37 to prevent the latter from coming out of the outer sleeve 40. A screw cap 43, which is retained on the plate member 21 by means of a circlip 44, is screwed onto the outer sleeve 40, to retain the latter relative to the plate member 21, and compresses a further spring 45 provided within the outer sleeve 40.

The sleeve 37 may be pushed towards the housing 15 against the force of spring 39, thereby enabling the balls 35 to move radially outwardly into the larger diameter part of the internal bore 41 of the outer sleeve 40, so that the head of a screw can pass between the balls 35 and engage the screwdriving member 12. The sleeve 37 is then released so that it is forced by the spring 39 away from the housing 15, causing the tapering bore 41 to move the balls 35 inwardly to grip the shank of the screw. The screw can therefore be guided and controlled effectively whilst the screwing operation is performed.

What is claimed is:

1. A driving tool for screw threaded fasteners, said tool having opposed ends, a shaft member at one of said ends adapted to be received in the jaws of a rotary machine, a screw driving member disposed at the other of said ends and a driving connection between said shaft member and said screw driving member, said driving connection comprising a housing, a drive plate and a driven plate disposed in said housing and having adjacent respective faces arranged in opposed relationship, at least one recess in each of said faces, said recesses being positionable for mutual alignment, a respective rolling member adapted to be received in and between one pair at least of said aligned recesses, biassing means operative to resiliently bias said plates into drive transmission relationship, and adjustment means adapted to allow the selective positional location of one said plate axially of and relative to the housing thereat to receive the other said plate into drive transmission relationship therewith under the effect of the biassing means.

2. A driving tool according to claim 1 wherein each of said faces has a like plurality of recesses therein.

3. A driving tool according to claim 2 wherein said tool has a central longitudinal axis and said plurality of recesses are disposed equally spaced radially from said axis and angularly around said axis.

4. A driving tool according to claim 3 wherein each face has three recesses therein.

5. A driving tool according to claim 2 wherein said like plurality of rolling members is provided.

6. A driving tool according to claim 1 wherein each rolling member is a ball.

7. A driving tool according to claim 1 wherein the driven plate is selectively positionally locatable in said housing and the drive plate is resiliently biassed towards the driven plate by spring means interposed between the housing and the driven plate.

8. A driving tool according to claim 1, wherein said adjustment means comprises a plurality of grooves of differing length extending longitudinally of the housing and, at least one spigot on said one plate receivable in any chosen one of said grooves.

9. A driving tool according to claim 1 wherein said shaft member is of hexagonal cross-section.

10. A driving tool according to claim 1, wherein the length of said housing is adjustable.

11. A driving tool according to claim 10 wherein said cover and annular part have cooperating screw-threads thereon.

12. A driving tool according to claim 1 comprising an axially directed spigot on one said plate and an axial bore on the other said plate, whereby said plates are located relative to each other by engagement of said axially directed spigot and said axial bore.

13. A driving tool according to claim 1 comprising fastener retention means.

14. A driving tool according to claim 13 wherein the driven plate has a cylindrical part, and said fastener retention means comprises a second plurality of balls, an inner sleeve slidably received on said cylindrical part of one of said plates, and an outer sleeve having a stepped and tapered internal bore, and said inner sleeve has a plurality of apertures in each of which a respective one of said second plurality of balls is received.

15. A driving tool according to claim 8 comprising a screw cap which is retained on said one plate and is screwed onto said outer sleeve, and a second compression spring located between said screw cap and said outer sleeve.

16. A driving tool according to claim 7 comprising a screw cap which is retained on said one plate and is screwed onto said outer sleeve, and a second compression spring located between said screw cap and said outer sleeve.

* * * * *